US006703962B1

(12) United States Patent
Marics et al.

(10) Patent No.: US 6,703,962 B1
(45) Date of Patent: Mar. 9, 2004

(54) MODULAR REMOTE CONTROLLER

(75) Inventors: Monica Marics, Boulder, CO (US); Clarke Stevens, Broomfield, CO (US); Lev Lawrence, Denver, CO (US)

(73) Assignee: MediaOne Group, Inc., Englewood, CO (US)

( * ) Notice: Subject to any disclaimer, the term of this patent is extended or adjusted under 35 U.S.C. 154(b) by 0 days.

(21) Appl. No.: 09/418,411

(22) Filed: Oct. 14, 1999

(51) Int. Cl.[7] ..... G08C 17/00
(52) U.S. Cl. ..... 341/176; 340/825.69; 361/679
(58) Field of Search ..... 340/825.26, 825.69, 340/825.25, 825.72, 825.22, 825.56; 341/23, 175, 176; 365/158, 169; 368/734; 361/679, 600, 640, 651, 657, 671, 680, 686, 725, 728

(56) References Cited

U.S. PATENT DOCUMENTS 4,728,949 A * 3/1988 Platte et al. ..... 340/825.37
4,918,439 A * 4/1990 Wozniak et al. ..... 340/825.69
5,598,162 A 1/1997 Terashima et al.
5,768,370 A * 6/1998 Maatta et al. ..... 379/433.01
5,841,390 A 11/1998 Tsui
5,854,594 A 12/1998 Lin et al.
5,892,500 A 4/1999 Kang et al.
5,971,855 A * 10/1999 Ng ..... 463/42
6,081,207 A * 6/2000 Batio ..... 341/20
6,264,559 B1 * 7/2001 Lawrence et al. ..... 348/552

* cited by examiner

*Primary Examiner*—Michael Horabik
*Assistant Examiner*—Hung Dang
(74) *Attorney, Agent, or Firm*—Brooks Kushman P.C.

(57) ABSTRACT

A remote controller for controlling the operation of a electronic appliance has a function or appearance which is changed by adding auxiliary modules to a base unit, allowing a user to adapt the remote controller to his specific needs. Once the module is coupled to the base unit an additional electronic appliance may be controlled. The auxiliary modules may be functional, including interface circuitry and adding more capability to the remote controller or non-functional, having no electrical circuitry. The functional modules may include but are not limited to display screens, speakers, keyboards, etc. The non-functional modules are added for the purpose of changing the appearance of the remote and/or for ease of handling or for attaching other accessories.

33 Claims, 5 Drawing Sheets

MODULAR REMOTE CONTROLLER

TECHNICAL FIELD

The present invention relates to remote controllers for controlling the operation of electronic appliances.

BACKGROUND ART

Conventional, remote controllers have a plurality of user keys disposed on the front surface of the controller. The user keys are manipulated to issue commands to an electronic appliance, such as a television or stereo system to change the operating state of the appliance. Typically, an infrared transmitter is used to communicate the commands to the electronic appliance.

Some prior art remote controllers incorporate display screens to increase their functionality. For example, the RC2000 Programmable Learning Remote controller offered by Marantz includes a plurality of user keys as well as a display screen. The RC2000 can control virtually an entire houseful of electronic entertainment equipment, including televisions, video recorders, audio/video receivers, DVD players, surround sound decoders, laser disc players, DSS systems, cable television boxes, compact disc players and cassette decks. Additionally, the RC2000 allows the user to assign labels to particular commands. Macro keys are also available to send a sequence of commands to a given electronic appliance.

Although, prior art remote controllers are versatile in their ability to control a multitude of electronic appliances they still lack the ability to couplingly receive modules after manufacture. Thus, conventional remote controllers are not capable of increasing or changing the functionality of the remote or changing the shape of the remote controller by removably affixing modules to the surfaces of the remote. It would be desirable to add modules or replace existing modules in order to customize to the remote control unit to the specific needs of a user. For example, a particular user may require speakers on the remote, a speaker module could be coupled to the remote. Further, a different user might require a video screen on the remote, a video screen module could be coupled to the remote. Other users may desire just to change the shape of the module, modules of different shapes could be added to fulfill this objective. A major advantage of a remote which has the capability to receive modules is that the remote's functionality can be continually increased without progressively increasing the size and weight of the remote. Many other advantages will become clear from the following disclosure.

Consequently, there is a need for an improved remote controller that is physically changeable such that the shape of the controller may be modified by the coupling of a module or modules to the remote controller. The addition of the modules to the remote controller should increase the functionality of the remote controller but must also change the shape of the remote controller.

DISCLOSURE OF INVENTION

Accordingly, it is an object of the present invention to provide a remote controller for controlling the operation of a least one electronic appliance, the remote controller having a base unit which is augmented, by attaching auxiliary modules thereto, for increasing the functionality of the remote controller.

It is another object of the present invention to provide a remote controller for controlling the operation of a least one electronic appliance, the remote controller having a base unit which is augmented by attaching non-functional auxiliary modules thereto, for changing the appearance of the base unit.

In accordance with these and other objects, the present invention provides a remote controller for controlling the operation of an electronic appliance. A base unit of the remote controller is augmented by adding auxiliary modules thereto. The auxiliary modules may be functional, adding more control or convenience capability to the remote controller or non-functional, containing no electrical circuitry. The non-functional modules are added to the base unit of the remote for the purpose of altering the appearance, for ease of handling, or for attaching other accessories. The present invention allows the user to adapt the remote controller to his specific needs.

Thus, in accordance with an aspect of the present invention, a remote controller for controlling the operation of at least one electronic appliance is provided. The remote controller has a base unit which is adapted to couplingly receive an auxiliary module. The base unit has a front surface and a first coupling surface adapted to couplingly receive the auxiliary module. A plurality of user selectable keys are defined on the front surface of the base unit. The plurality of keys are manipulated by a user to send commands via a transmitter to the electronic appliance. The transmitter is housed within the base unit. The base unit and the coupled auxiliary module have increased functionality over the stand alone base unit. Alternatively, the base unit and coupled auxiliary module have a different appearance than the stand alone base unit.

In accordance with another aspect of the present invention, a remote controller for controlling the operation of at least one electronic appliance is provided. The remote controller includes a base unit having a front surface, at least two side coupling surfaces adjacent to the front surface, and a back coupling surface diametrically opposite the front surface. Further, a plurality of user keys are defined on the front surface. The user keys are connected to a transmitter for communicating information to at least one electronic appliance. A module is removably affixed to the following surfaces, the two side coupling surfaces and the bottom coupling surface. The base unit and module together have increased functionality and/or have a different appearance over the stand alone base unit.

The advantages accruing to the present invention are numerous. For example, the present invention allows a user to increase the functionality of a remote controller. The present invention provides a remote controller which can be adapted to satisfy a user's specific needs by adding user selected modules to the base unit of the remote controller. Further, the base unit can accept functional as well as non-functional modules depending on the particular purpose sought.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
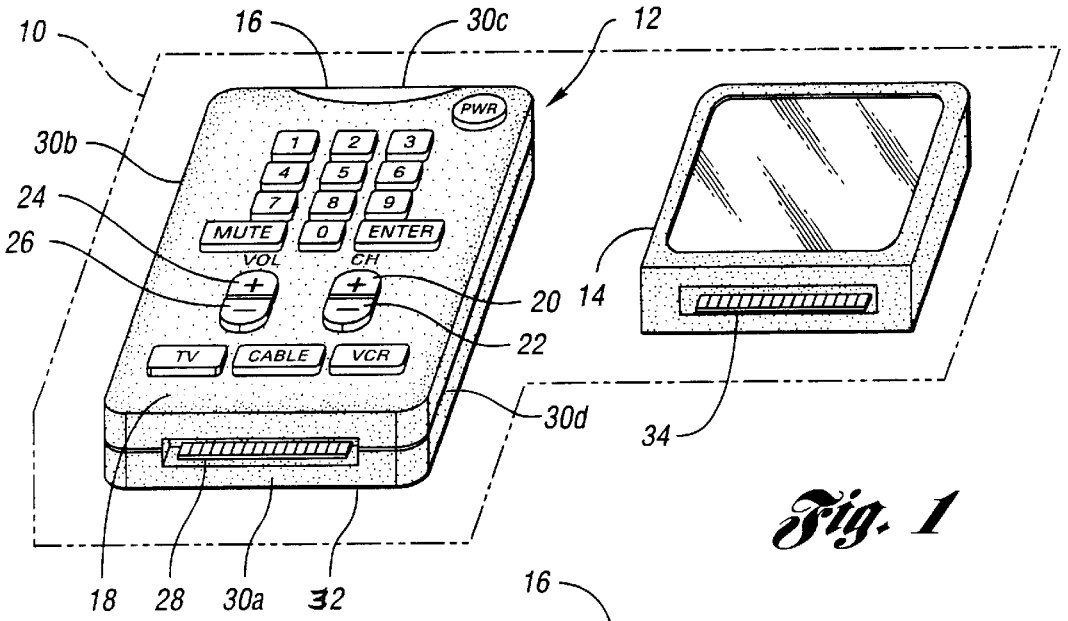
FIG. 1—is a perspective view of a base unit, the base unit having a plurality of keys and a transmitter for issuing commands to an electronic appliance, the base unit is adaptable to receive a module, in accordance with the present invention.

Referring now to FIG. 1, a remote control device 10 according to the present invention is illustrated. Remote control device 10 has a the base unit 12 and an auxiliary module 14. The base unit 12 includes a plurality of keys for sending commands to a television (not shown) or to other electronic appliances such as VCRs and stereos. Each time a key is depressed a code associated with the key is transmitted by a transmitter such as an infrared transmitter 16 to the television to affect the operation of the television. A pair of channel up and channel down keys 20 and 22 are provided on the base unit 12 for moving up the channels or down the channels of the television. A pair of volume keys volume up 24 and volume down 26 are provided to increase or decrease the volume of the television respectively. The present invention contemplates a base unit having a variety of additional keys for carrying out other operations.

Furthermore, base unit 12 has a front surface 18 which defines a first plan view shape. The first plan view shape of the base unit 12 is shown generally as being rectangular, however this is by way of example only as the present invention contemplates other plan view shapes. Other plan view shapes may include but are not limited to square, conical, triangular, and circular for example.

With continuing reference to FIG. 1, the base unit 12 is shown with the front surface 18 and four adjacent side surfaces 30*a*, 30*b*, 30*c* and 30*d*. Base unit 12 also has a back surface 32 which is opposed to the front surface 18 and is generally planar. An adapter 28 shown on the side surface 30*a* is configured to couplingly receive the module 14. The adapter 28 is shown on the side surface 30*a*, however the adapter may be located on any one or more of said surfaces 30*a*, 30*b*, 30*c*, and 30*d* of the base unit 12. For example and as will be illustrated hereinafter, the module may be coupled to the back surface 32 and a side surface 30*a*, 30*b*, 30*c*, or 30*d* or the module may be coupled to just three side surfaces.

Figure 7:
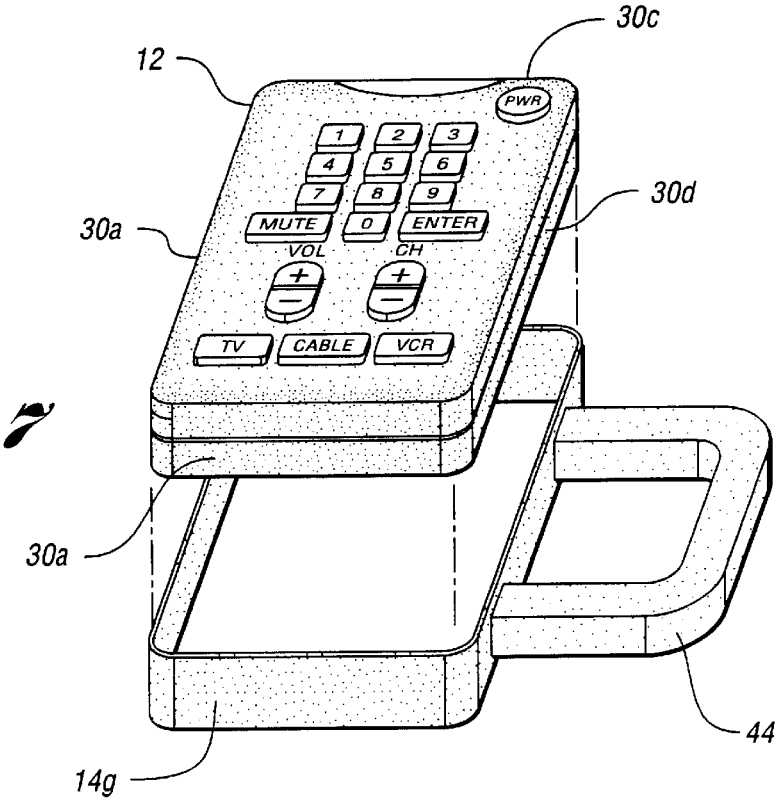
FIG. 7—is a perspective view of a base unit with an auxiliary module attached thereto, the base unit having a plurality of keys and a transmitter for issuing commands to an electronic appliance, the base unit is further shown receiving the module on the base unit's back surface and on one of the base unit's side surfaces, in accordance with the present invention.

The module 14 has a module adaptor 34 which is configured to cooperate with the adapter 28 to allow the module 14 to be removably coupled to the base unit 12. The module 14 may include functional sub-components such as speakers, video displays, keyboards, and the like. Alternatively, the module 14 may be non-functional having no circuitry or electrical communication with the base unit of the remote controller 10. The auxiliary module 14 which is non-functional may provide a particular shape which is suitable for a desired purpose such as a handle (as shown in FIG. 7) or a shape which allows the remote controller to be accessorized with other items such as clothes. For example, to entertain children the remote controller could be coupled to one or more modules to form a second plan view shape resembling a cartoon figure, such as an Action Hero (i.e. Superman). The child could dress Superman during the running of the Superman TV program thus, increasing the entertainment value of the television program.

The adapter 28 and module adapter 34 which are capable of removably joining the module 14 to the base unit 12 may be constructed of a known coupling means. By way of example only, the adapter 28 and module adapter 34 may be coupled through a tongue and groove arrangement, where adapter 28 forms the tongue and module adaptor 34 forms the groove or vice versa. The tongue and groove configuration provides a mechanical coupling of the base unit 12 to the module 14. If an electrical connection is required an edge connector may be provided, for example, in addition to the tongue and groove mechanical coupling configuration. Of course, the present invention contemplates other mechanical as well as electrical coupling arrangements.

Figure 2:
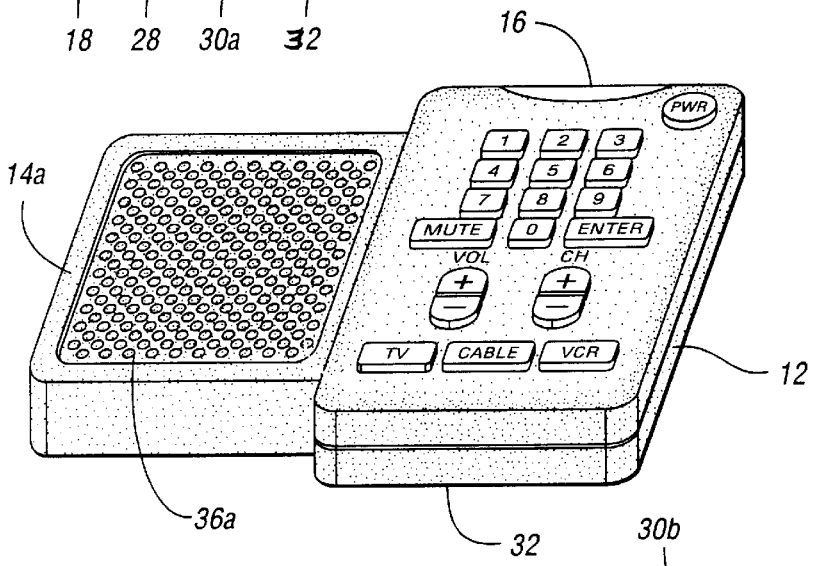
FIG. 2—is a perspective view of a base unit with an auxiliary module attached thereto, the base unit having a plurality of keys and a transmitter for issuing commands to an electronic appliance, the base unit is further shown receiving a module on the base unit's back surface, in accordance with the present invention.

Referring now to FIG. 2, a module 14*a* is shown coupled to the back surface 32 of the base unit 12. The coupling of the module 14*a* to the back surface 32 of base unit 12 changes the plan view shape of the controller 10 from a rectangular first plan view shape to a multi-sided polygon second plan view shape. By example the module 14*a* may incorporate a speaker 36 which requires an electrical connection to the base unit 12 of the remote controller 10 to operate. As stated previously, the module 14*a* may be connected to the base unit 12 using a module adaptor 34 and an adaptor 28 having an edge connector or a pin/hole connector arrangement. Required speaker circuitry would be located within the base unit 12 and be connected to the module adaptor 34. Furthermore, a mechanical fastening means may be employed to ensure that the electrical connection is not disrupted during use. For example, the tongue and groove arrangement in addition to the edge connector may be used.

Figure 3:
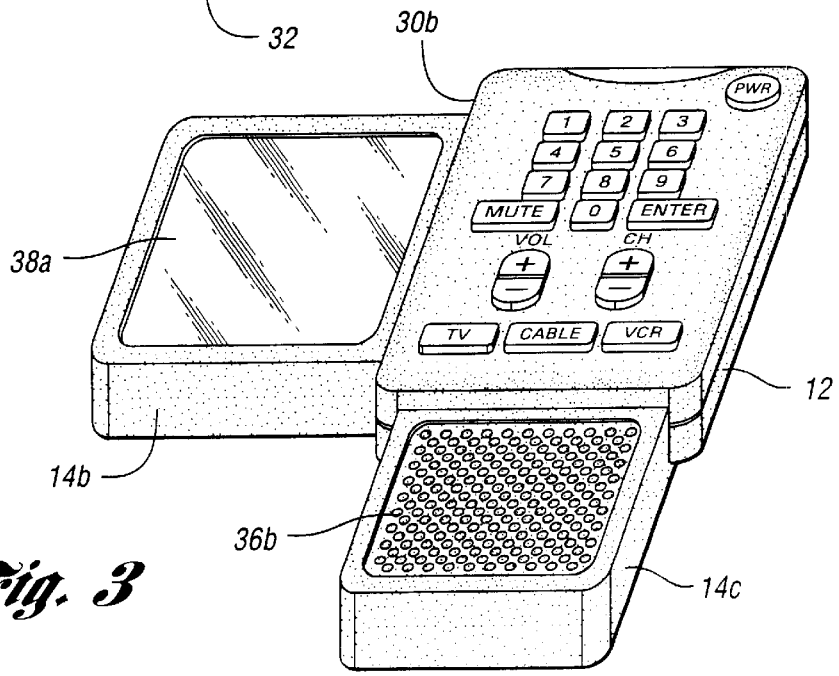
FIG. 3—is a perspective view of a base unit with an auxiliary module attached thereto, the base unit having a plurality of keys and a transmitter for issuing commands to an electronic appliance, the base unit is further shown receiving a module on one of the base unit's side surfaces, in accordance with the present invention.

Module 14*b* is shown in FIG. 3, coupled to the side surface 30*b* of the base unit 12 and another module 14*c* to the back surface of the base unit 12. For example, the module 14*b* incorporates a video display device 38*a*. The coupling of modules 14*b* and module 14*c* to the side and back surfaces of the base unit 12 changes the first plan view shape of the base unit 12 from a rectangle to a second plan view shape which is not rectangular. Since module 14*b* is a video display screen an electrical connector in the form of an edge connector or a fifteen pin mini d-type connector is required to receive video signals from the base unit 12. Video capture and display circuitry required to show the video picture would be housed within the module 14*b*. Module 14*c*, for example, may incorporate a speaker 38*b* as shown. Speaker interface circuitry for receiving voice signals may be housed within the speaker 38*b*. Electrical connectors such as an edge connector may be used to communicate the voice signals from the base unit 12 to the speaker 38*b*.

Figure 4:
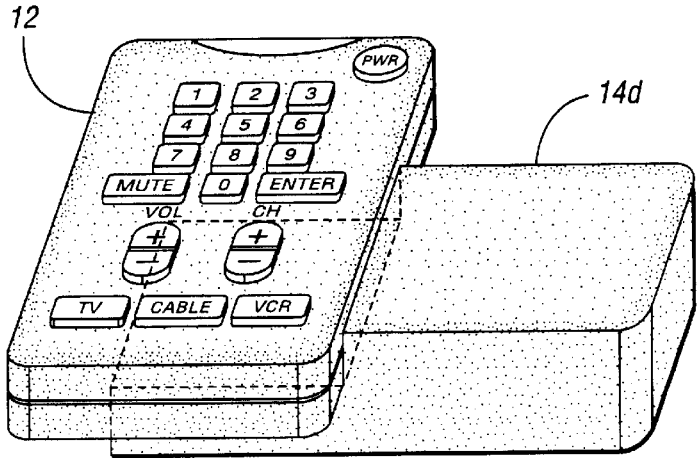
FIG. 4—is a perspective view of a base unit with an auxiliary module attached thereto, the base unit having a plurality of keys and a transmitter for issuing commands to an electronic appliance, the base unit is further shown receiving a module on two of the base unit's side surfaces, in accordance with the present invention.

A module 14*d* is shown in FIG. 4, coupled to the back surface 32 and the side surfaces 30*d* of the base unit 12. The module 14*d* is shown by example, generically, as a block. However, module 14*d* may take on a particular shape as required. The desired shape would create a second plan view shape of the base unit 12 which would be different than the first plan view shape. The module 14*d* is mechanically coupled to the base unit 12 and as such no electrical adaptors or circuitry would be required. The shape of the module may vary depending on the purpose for coupling the module to the base. For Example, the module could take on a shape which would be suitable for children to dress up with clothes.

Figure 5:
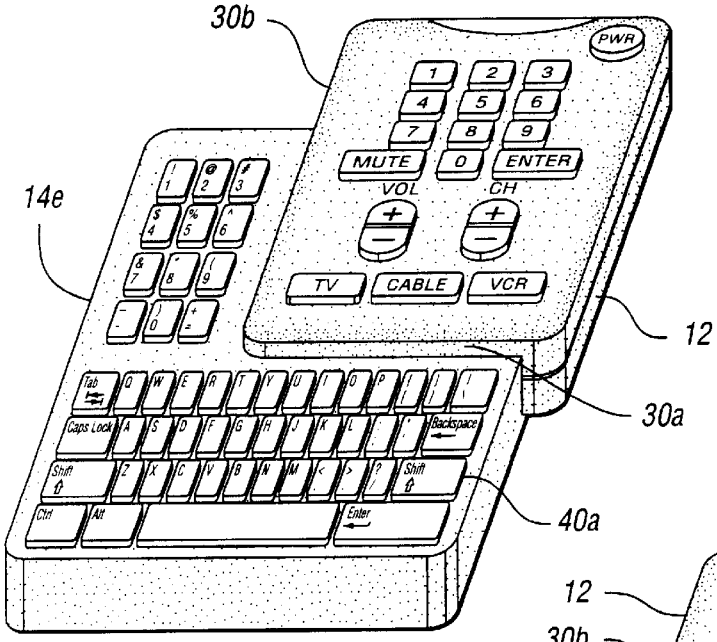
FIG. 5—is a perspective view of a base unit with an auxiliary module attached thereto, the base unit having a plurality of keys and a transmitter for issuing commands to an electronic appliance, the base unit is further shown receiving a module on three of the base unit's side surfaces, in accordance with the present invention.

Referring now to FIG. 5, a module 14*e* is shown coupled to two side surfaces 30*a* and 30*b* of the base unit 12. The module 14*e* shown incorporating a keyboard 40*a* for inputting messages. The messages could be forwarded to other systems via the Internet. The module 14*e* in this case adds additional functionality to the base unit 12 namely, the capability to create letters or memos. Since electrical signals would need to be transmitted between the base unit and the module 14*e* adaptor 28 and module adaptor 34 could be an edge connector and slot as well know in the art. Further, required keyboard interface circuitry would be housed within the module 14*e*. The interface circuitry would be responsible transmitting the inputted key strokes to the base unit 12. Base unit 12 could then transmit the stored message via the transmitter to a remote location.

Figure 6:
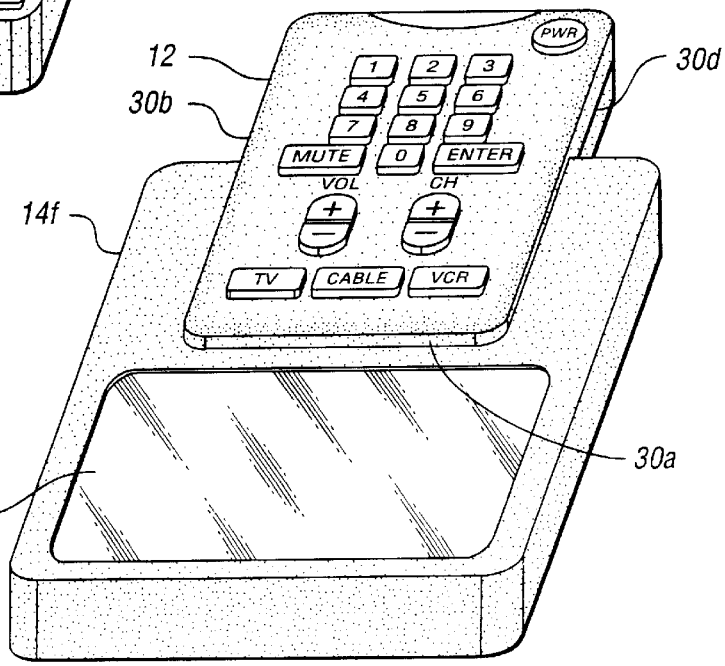
FIG. 6—is a perspective view of a base unit with an auxiliary module attached thereto, the base unit having a plurality of keys and a transmitter for issuing commands to an electronic appliance, the base unit is further shown receiving a module on four of the base unit's side surfaces, in accordance with the present invention.

Module 14*f* is shown in FIG. 6 coupled to three side surfaces of the base unit 12. The first plan view shape of the base unit 12 is, generally, rectangular when the module 14*f* is coupled to the base unit 12 a second plan view shape is created which is different than the first plan view shape. For example, module 14*f* incorporates a video display screen 38*b* for viewing television programming or displaying other images. Video display and interface circuitry required to operate the display may be housed within the module 14*f*. Adapter 28 and modular adapter 34 would be electrical connectors such as edge connectors or the like.

Referring now to FIG. 7, base unit 12 and a module 14*g* is shown in an exploded view wherein the base unit 12 is receivable and coupleable to the module 14*g*. The module 14*g* is coupled to four side surfaces 30*a*, 30*b*, 30*c*, and 30*d* of the base unit 12. The first plan view shape of the base unit 12 is generally rectangular, however, when the module 14*g* is coupled to the base unit 12 a second plan view shape is created which is not rectangular. For example the module 14*g* is shown incorporating a handle 44. The handle may be used for grasping the remote and transporting the remote to a desired location. The module 14*g* is removably attached to the base unit 12 through a mechanical coupling means such as described above.

Figure 8:
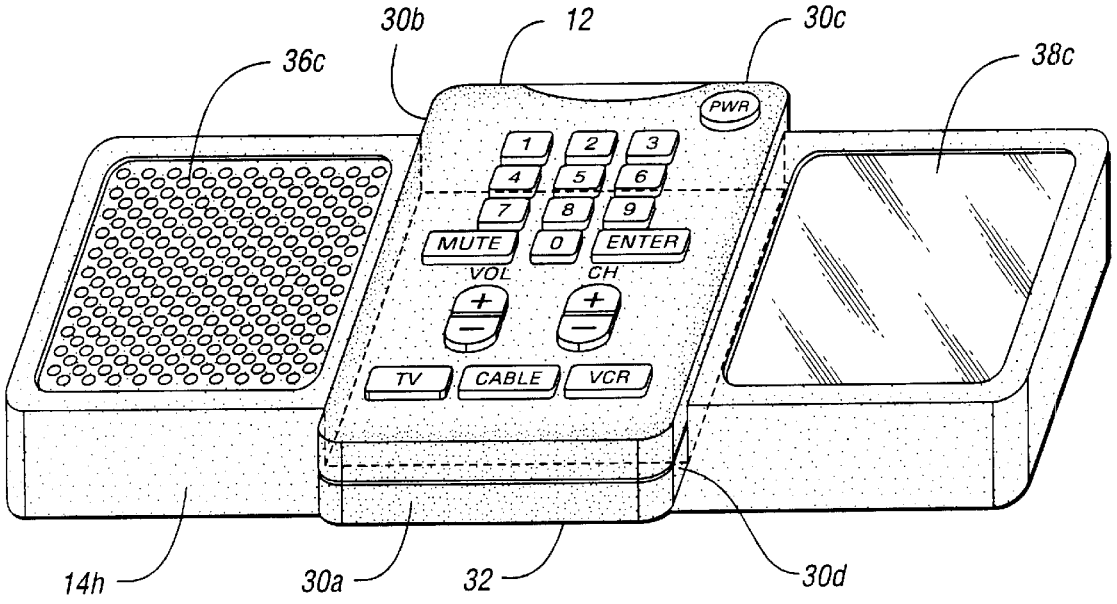
FIG. 8—is a perspective view of a base unit with an auxiliary module attached thereto, the base unit having a plurality of keys and a transmitter for issuing commands to an electronic appliance, the base unit is further shown receiving the module on the base unit's back surface and on two of the base unit's side surfaces, in accordance with the present invention.

Referring now to FIG. 8, the module 14*h* is shown coupled to the two side surfaces 30*b* and 30*d* and the back surface 32 of the base unit 12. The first plan view shape of the base unit 12 is, generally, rectangular however when the module 14*h* is coupled to the base unit 12 a second plan view is created which is different than the first plan view shape. The module 14*h* as shown incorporates a video display screen 38*c* for viewing television programming or displaying other images and a speaker 36*c* for hearing audible signals. Required interface circuitry for the video display 38*c* and the speaker 36*c* would be housed within the module 14*h*. Additionally, the adaptor 28 and module adaptor 34 would provide a mechanical attachment as well as electrical communication between the base unit 12 and the module 14*h*.

Figure 9:
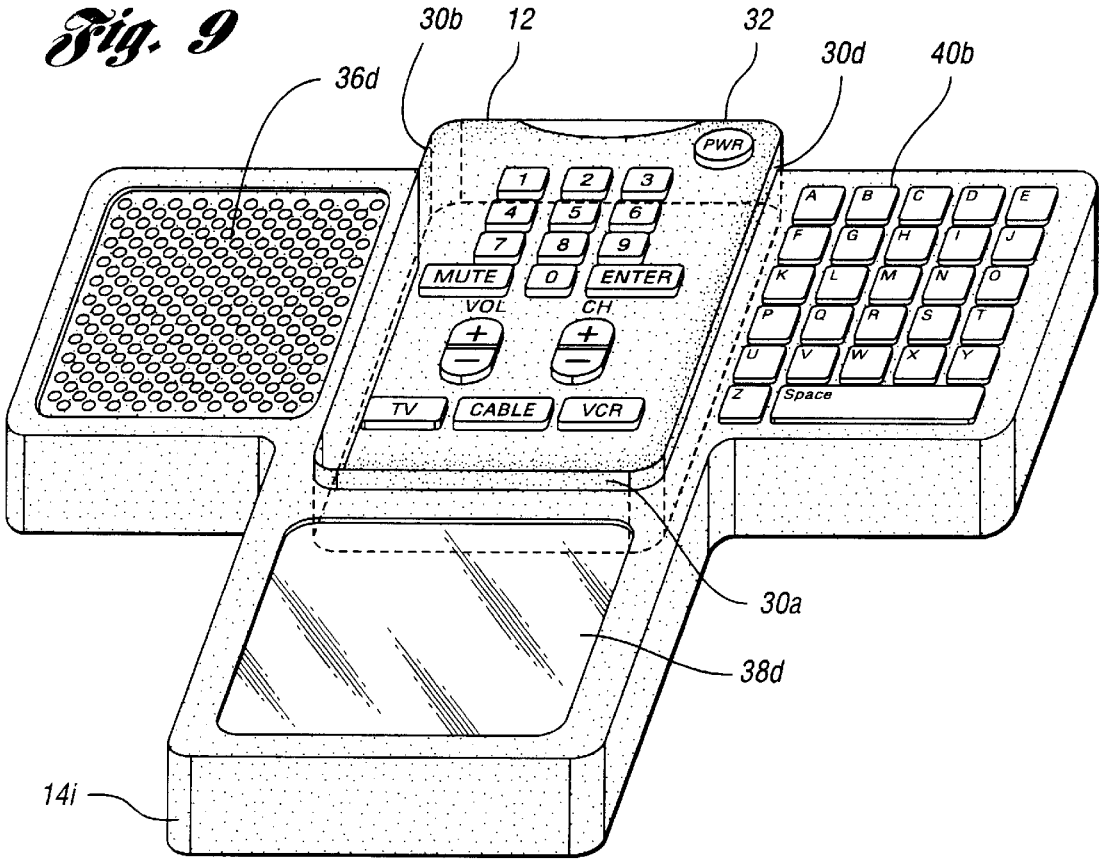
FIG. 9—is a perspective view of a base unit with an auxiliary module attached thereto, the base unit having a plurality of keys and a transmitter for issuing commands to an electronic appliance, the base unit is further shown receiving the module on the base unit's back surface and on three of the base unit's side surfaces, in accordance with the present invention.

Referring now to FIG. 9, the module 14*i* is shown coupled to three side surfaces 30*a*, 30*b*, and 30*d* and the back surface 32 of the base unit 12. The first plan view shape of the base unit 12 is generally rectangular, however, when the base unit 12 is coupled to the module 14*i* a second plan view shape is created which is different than the first plan view shape. The module 14*i* as shown, for example, incorporates a speaker 36*d* and a keyboard 40*b*. The speaker 36*d* and keyboard 40*b* would require interface circuitry to communicate electrical signals between the base unit 12 and the module 14*i*. The circuitry may be located within the module 14*i*.

Figure 10:
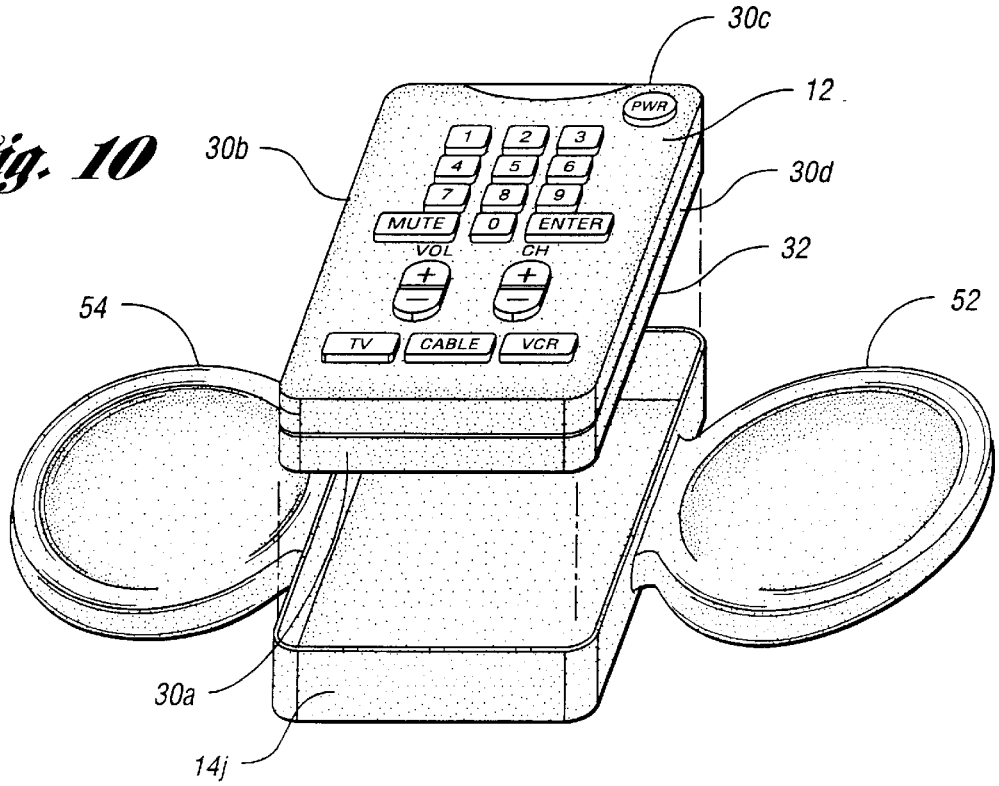
FIG. 10—is a perspective view of a base unit with an auxiliary module attached thereto, the base unit having a plurality of keys and a transmitter for issuing commands to an electronic appliance, the base unit is further shown receiving the module on the base unit's back surface and on four of the base unit's side surfaces, in accordance with the present invention.

Referring now to FIG. 10, the module 14*j* is shown coupled to four side surfaces 30*a*, 30*b*, 30*c* and 30*d* and to the back surface 32 of the base unit 12. The first plan view shape of the base unit 12 is, generally, rectangular however when the module 14*j* is coupled to the base unit 12 a second plan view shape is created which is different than the first plan view shape. The module 14*j* as shown for example incorporates a shape, such as, mouse ears 52 and 54 for entertaining children when the children are watching a television program. The newly created shape provided by coupling the module 14*j* to the base unit 12 increases the entertainment aspects of the television show presently being viewed. Alternatively, the mouse ears 52 and 54 could be used as ash trays for adults who are smoking while watching their favorite TV programs.

Figure 11:
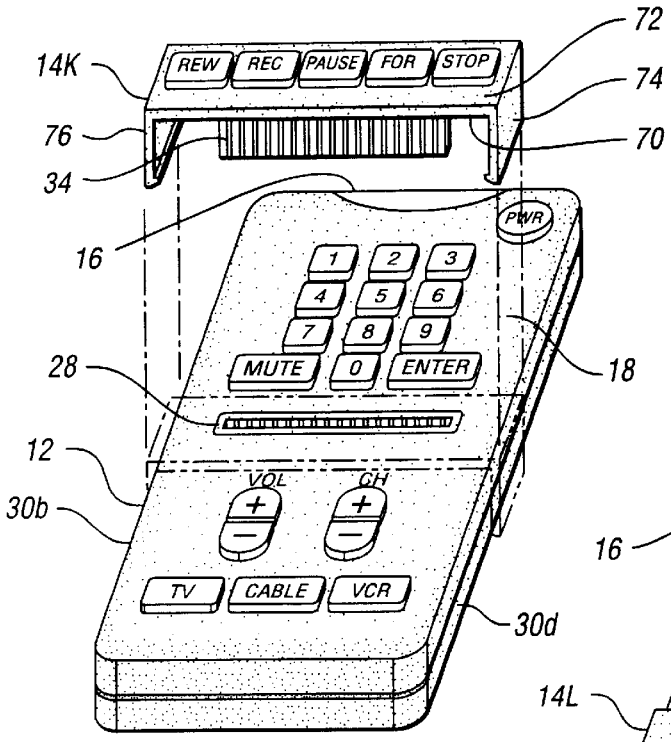
FIG. 11—is a perspective view of an embodiment of the present invention, a base unit with an auxiliary module is shown, wherein the base unit has a plurality of keys and a transmitter for issuing commands to an electronic appliance.
Figure 12:
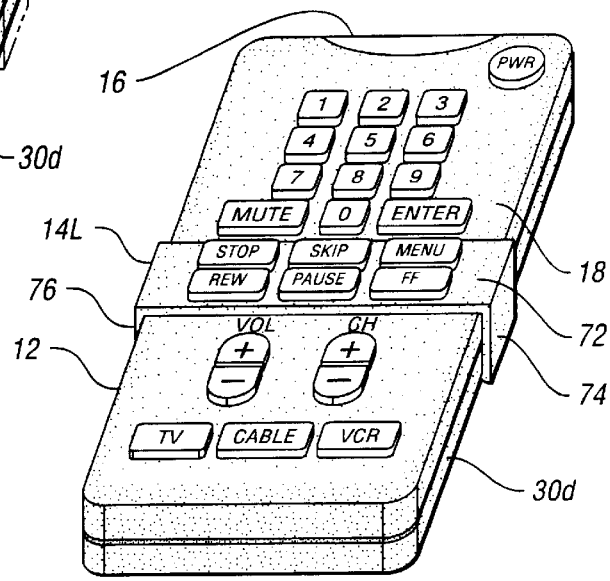
FIG. 12—is a perspective view of an auxiliary module for controlling an additional electronic appliance when the module is coupled to the base unit, in accordance with the present invention.
Figure 13:
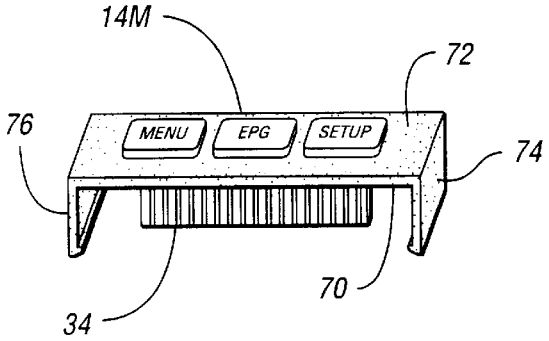
FIG. 13—is a perspective view of another auxiliary module for controlling a different electronic appliance when the module is coupled to the base unit, in accordance with the present invention.

Referring now to FIGS. 11–13, another embodiment of the present invention is shown. FIG. 11 illustrates the base unit 12 having the adapter 28 located on the top surface of the base unit 12. Additionally, auxiliary module 14*k* is shown having the module adapter 34 attached to the bottom surface 70 of the auxiliary module 14*k*, for slidably coupling the auxiliary module to the base unit. Auxiliary, module 14*k* also has a plurality of user keys disposed on a top surface 72, for operating a video cassette recorder/player. Such keys would include, but are not limited to, rewind, record, pause, fast forward (FF), and stop. Furthermore, module 14*k* includes a pair of downwardly extending legs 74 and 76 which are configured to span the sides 30*b* and 30*d* of the base unit 12. As the module 14*k* is places over top of aid pushed down onto the base unit 12 module adapter 34 enters adapter 28 making electrical contact with the internal circuitry of the base unit 12. Module 14*k* is pressed down onto the base unit until the legs 74 and 76 "snap" and extend around the back surface 32 of the base unit.

FIGS. 12 and 13 illustrate similar auxiliary modules as the one shown in FIG. 11 however having different operation keys and control functions. For example, FIG. 12 shows an auxiliary module 14*l* for controlling the operation of a DVD player. Auxiliary module 14*l* attaches to the base unit in the same way as auxiliary module 14*k*, as described above. However, module 14*l* has a plurality of keys directed toward controlling a DVD player. Such keys include but are not limited to, rewind, pause, fast forward (FF), stop, skip, menu. Similarly, as shown in FIG. 13 auxiliary module 14*m* is shown for controlling the operation of an enhanced television. As described above auxiliary module is electrically coupled to the base unit 12 via adapter 28 and module adapter 34. Module 14*m* also includes a plurality of user keys which include but are not limited to, a menu key, an electronic programming guide (EPG) and a setup key.

Of course, other similar auxiliary modules coupled to the base unit to increase functionality are contemplated by the present invention. For instance, electronic appliances such as stereos and set-top cable boxes may be controlled by coupling respective auxiliary modules to the base unit 12. Such auxiliary modules would include user keys related to the specific operation of the electronic appliance being controlled.

Figure 14:
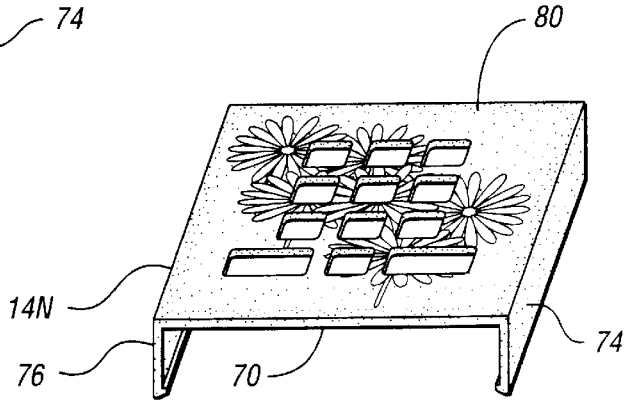
FIG. 14—is a perspective view of an embodiment of the present invention, wherein the base unit is shown with an auxiliary module which is non-functional and overlays the base unit for the purpose of changing the appearance of the front surface of the base unit, in accordance with the present invention.

With reference to FIG. 14 a non-functional auxiliary module 14*n* is shown according to the present invention. Non-functional auxiliary module 14*n* is configured to overlay the base unit 12. More specifically, auxiliary module 14*n* has a surface 80 which is different than the front surface 18 of the base unit 12 and is placed over and on top of the base unit 12 for the purpose of changing the surface appearance of the base unit. For example, a user may desire to have a surface with a specific design or image. The user would simply overlay the auxiliary module 14*n* having the desired graphic or image over top of the base unit 12. The auxiliary module would "snap" into place as described above. The present invention allows the user of the remote controller to change the appearance of the remote without having to change the base unit, which is the most costly component of the remote.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A remote controller for controlling the operation of at least one electronic appliance, the remote controller comprising:

a base unit having a front surface, a first coupling surface, and a second coupling surface;

a plurality of user selectable keys defined on the front surface;

a transmitter housed within the base unit for communicating information between the base unit and the at least one electronic appliance; and at least one module arranged to be removably coupled to the first coupling surface and the second coupling surface.

2. The remote controller according to claim 1, wherein the first coupling surface is disposed on a back surface diametrically opposite the front surface.

3. The remote controller according to claim 1, wherein the first coupling surface is disposed on a side surface adjacent to the front surface.

4. The remote controller according to claim 1, further including a third coupling surface, wherein the module is coupled to the first coupling surface, the second coupling surface, and the third coupling surface.

5. The remote controller according to claim 4, further including a fourth coupling surface, wherein the module is coupled to the first coupling surface, the second coupling surface, the third coupling surface, and the fourth coupling surface.

6. The remote controller according to claim 1, wherein the module further includes a module adapter for coupling the module to the base unit.

7. The remote controller according to claim 6, wherein the module adapter provides an electrical connection between the module and the base unit.

8. The remote controller according to claim 6, wherein the module adapter provides a mechanical connection between the module and the base unit.

9. The remote controller according to claim 1, further comprising a base adapter for coupling the base unit to the module.

10. The remote controller according to claim 1, wherein the user interface includes a speaker.

11. The remote controller according to claim 1, wherein the user interface includes a video display screen.

12. The remote controller according to claim 1, wherein the user interface includes a keyboard.

13. The remote controller according to claim 1, wherein the at least one module includes a handle.

14. A remote controller for controlling the operation of electronic appliances, the remote controller comprising:

a base unit having a front surface, first and second side coupling surfaces adjacent to the front surface, and a back coupling surface diametrically opposite the front surface;

a plurality of user keys defined on the front surface;

a transmitter connected to the base unit for communicating information to the electronic appliances; and a module removably coupled to at least two of the first side coupling surface, the second side coupling surface, and the back coupling surface, the module including a user interface for providing an auxiliary input/output function to a user.

15. The remote controller according to claim 13, wherein the user interface includes a speaker.

16. The remote controller according to claim 14, wherein the module is coupled to at least one of the first and second side coupling surfaces and to the back coupling surface.

17. The remote controller according to claim 13, wherein the user interface includes a video display screen.

18. The remote controller according to claim 14, wherein the module is coupled to the first and second side coupling surfaces.

19. The remote controller according to claim 14, further including a third side coupling surface, wherein the module is coupled to the first side coupling surface, the second side coupling surface, and the third side coupling surface.

20. The remote controller according to claim 19, further including a fourth side coupling surface, wherein the module is coupled to the first side coupling surface, the second side coupling surface, the third side coupling surface, and the fourth side coupling surface.

21. The remote controller according to claim 14, wherein the base unit further includes a base adapter and the module further includes a module adapter, the base and module adapters mating to couple the module and the base unit.

22. The remote controller according to claim 21, wherein mating of the base and module adapters provides an electrical connection between the module and the base unit.

23. The remote controller according to claim 21, wherein mating of the base and module adapters provides a mechanical connection between the module and the base unit.

24. The remote controller according to claim 13, wherein the user interface includes a keyboard.

25. The remote controller according to claim 13, wherein the module includes a handle.

26. A remote controller for controlling the operation of electronic appliances, the remote controller comprising:

a base unit having a front surface, the front surface including a coupling surface;

a plurality of user keys defined on the front surface;

a transmitter connected to the base unit for communicating information to the electronic appliances; and at least one module removably coupled to the coupling surface.

27. The remote controller of claim 26 wherein the module allows the remote controller to control an additional electronic appliance.

28. The remote controller of claim 26 wherein the module changes the appearance of the front coupling surface.

29. The remote controller of claim 26 wherein the module includes a plurality of apertures for allowing the user keys to protrude through the module.

30. The remote controller of claim 26 wherein the module includes a plurality of keys for controlling an electronic appliance.

31. The remote controller of claim 30 wherein the plurality of keys control a video cassette recorder.

32. The remote controller of claim 30 wherein the plurality of keys control a digital video device player.

33. The remote controller of claim 30 wherein the plurality of keys control an enhanced television.

* * * * *

UNITED STATES PATENT AND TRADEMARK OFFICE

CERTIFICATE OF CORRECTION

PATENT NO. : 6,703,962 B1
DATED : March 9, 2004
INVENTOR(S) : Monica Marics et al.

It is certified that error appears in the above-identified patent and that said Letters Patent is hereby corrected as shown below:

Column 9,
Lines 4 and 9, delete “13” and insert -- 14 --.

Column 10,
Lines 1 and 3, delete “13” and insert -- 14 --.

Signed and Sealed this

Sixth Day of July, 2004

JON W. DUDAS
*Acting Director of the United States Patent and Trademark Office*